United States Patent [19]

Ruiz

[11] 4,275,447

[45] Jun. 23, 1981

[54] METHOD OF REGULATION OF THE WATER LEVEL IN BOILERS OR STEAM GENERATORS

[75] Inventor: Pierre Ruiz, Le Blanc Mesnil, France

[73] Assignee: Framatome, Courbevoie, France

[21] Appl. No.: 38,304

[22] Filed: May 11, 1979

[30] Foreign Application Priority Data

May 25, 1978 [FR] France ..... 78 15505

[51] Int. Cl.[3] ..... G06F 15/52; G06F 15/46; G21C 7/00

[52] U.S. Cl. ..... 364/494; 60/646; 60/665; 176/24; 290/40 C; 364/504

[58] Field of Search ..... 364/492, 494, 504; 60/646, 660, 665, 667; 415/15, 17; 290/40 R, 40 C; 176/19 R, 19 EC, 20 R, 24, 25, 21, 55

[56] References Cited

U.S. PATENT DOCUMENTS

| | | | |
|---|---|---|---|
| 3,837,167 | 9/1974 | Durrant et al. | 60/665 X |
| 3,931,500 | 1/1976 | Berkebile et al. | 364/504 X |
| 4,056,331 | 11/1977 | Sato | 364/494 X |
| 4,061,533 | 12/1977 | Durrant | 364/494 X |
| 4,120,159 | 10/1978 | Matsumoto et al. | 364/494 X |

*Primary Examiner*—Joseph F. Ruggiero
*Attorney, Agent, or Firm*—Haseltine and Lake

[57] ABSTRACT

Method of regulation of the water level in boilers or steam generators, in which the inlet flow of feedwater is regulated in response to a deviation signal proportional to the difference between the real measured water level and a reference level, the proportionality factor being a linear function of the power level of the boiler with respect to the nominal power, modified by a non-linear function of $\xi$ which preserves very low values for $\xi$ close to zero and increases very rapidly for higher values of $\xi$ so that the total gain is increased for low power levels and high values of $\xi$ within a restricted range.

4 Claims, 1 Drawing Figure

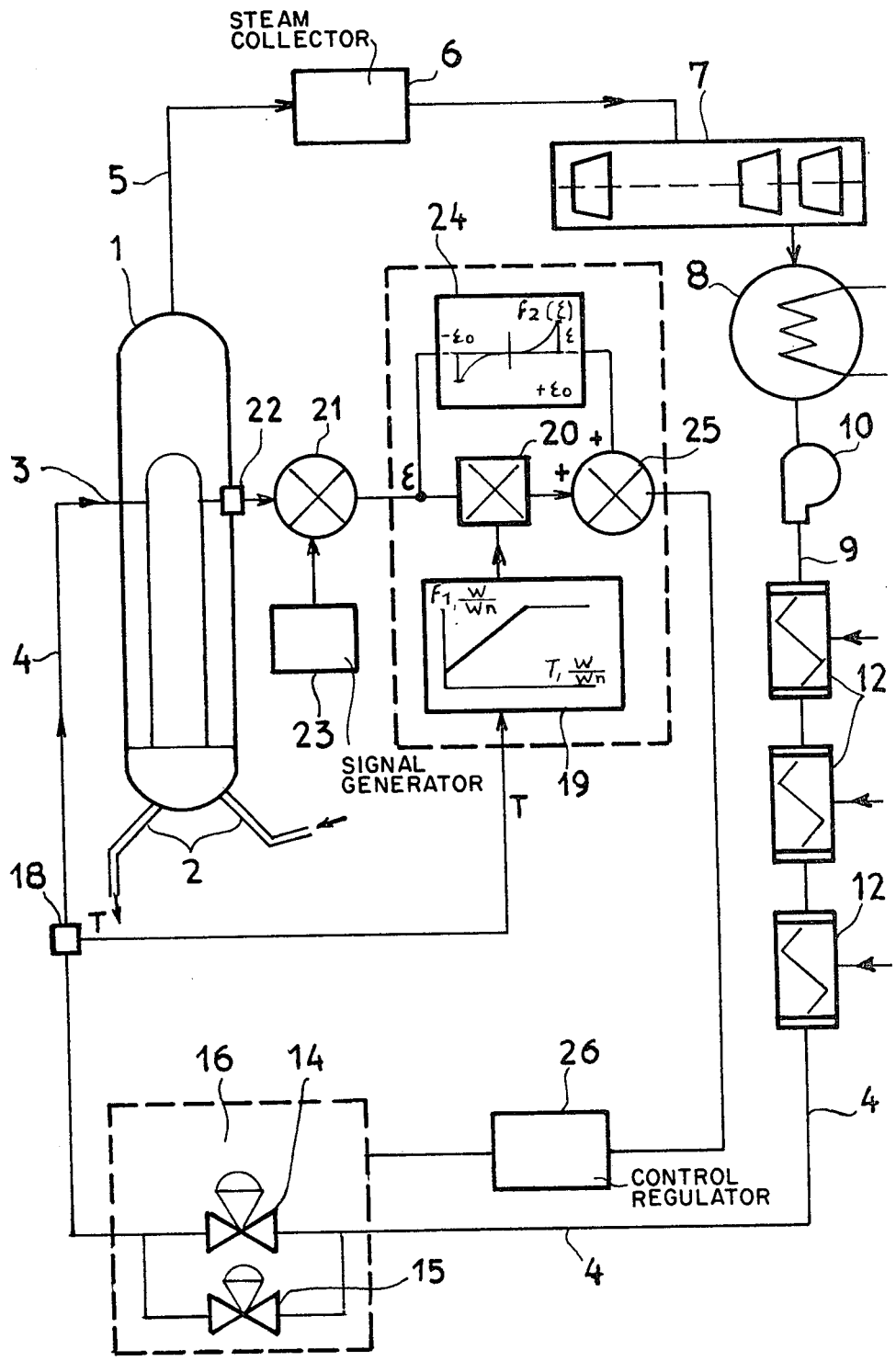
STEAM COLLECTOR
6
7
5
24
1
8
22
21
20
25
10
3
ε
9
4
12
23
SIGNAL GENERATOR
19
T
2
18
T
12
16
14
26
4
CONTROL REGULATOR
15
4

METHOD OF REGULATION OF THE WATER LEVEL IN BOILERS OR STEAM GENERATORS

The invention refers to a method of regulation of the water level in boilers or steam generators during the course of operation and more particularly during the starting-up phase.

BACKGROUND

In the case of generators of steam from pressurized-water nuclear reactors the regulation of this water level is rendered difficult by the size of the flows or rates of recirculation necessary.

In the case of generators of steam from pressurized-water reactors the generator consists of an enclosure of large dimensions inside which are mounted tubes fixed into a tube plate and conveying the primary fluid which is water under pressure. The enclosure likewise receives feedwater which comes to fill the generator up to a certain level and circulates in contact with the tubes conveying the primary fluid during its time spent in the steam generator. This contact with the primary-fluid tubes enables vaporization of the feedwater in the upper portion of the steam generator, this steam being sent to the turbine and feedwater coming to replace in the steam generator the water which has been evaporated.

During the course of this dynamic process automatic regulation of the water level in the steam generator is necessary and safety devices are provided for the case where the water level deviates from the chosen reference level.

During the operation of the nuclear reactor disturbing elements intervene to produce more or less large variations in the water level. These disturbing elements are, for example, variations in the flow of steam as a function of the power required of the turbine, the flow and temperature of the feedwater and the temperature of the primary circuit, which likewise depend amongst other things upon the power level demanded with respect to the nominal power. Other elements may likewise intervene casually at the time of abrupt variations in load or of faulty operation of the reactor.

Hence the duty of the device for automatic regulation of level is to maintain this water level in the steam generator as constant as possible in spite of these disturbing elements during the operation of the steam generator. The level regulation device includes in general a unit enabling the measurement of the real instantaneous level in the steam generator, the comparison of this level with a reference level, the working out of a deviation signal proportional to the difference $\xi$ between the measured water level and the reference level and the introduction of this signal into a regulator which enables the inlet flow of feedwater into the steam generator to be modified by way of valves. In general two valves are employed of which one is employed for flows higher than 15 or 20% of the nominal flow of water and the other for flows lying between 0 and 15 or 20% of the nominal flow of feedwater.

The feedwater is itself put back into circulation by a circuit which collects the water recovered at the outlet of the condenser of the turbine and includes a set of reheaters which recover the residual heat in the steam before draining to the condenser.

Thus the temperature of the feedwater is a function of the power level demanded at the turbine.

The proportionality factor or gain by which the signal is multiplied, which represents the deviation in level for working out the signal introduced into the regulator which enables control of the valves is a linear function of the power level with respect to the nominal power, that is to say, of the ratio of the real power to the nominal power. In reality as there exists an unequivocal relationship between the temperature of the feedwater and the power level, under normal conditions of operation the parameter which is taken into account for the determination of the gain is this temperature of the feedwater.

In the regulation chains at present employed the linear variation of the loop gain is a function of the main parameter, that is to say, of the temperature of the feedwater which directly influences the dynamics of the process and is representative of its load level. In general a very low regulation loop gain is imposed at low load so as to ensure good damping.

In practice, in the devices considered above for regulation of the steam generators of pressurized-water reactors the gain varies between 1 and 8 when the power passes from the value 0 to the nominal value.

The result is that at low load and at low temperature of the feedwater the gain is a minimum, which considerably reduces the performance of the regulation device. This minimum gain does not enable the transitory disturbances to which the installation may be subjected, to be effectively compensated, with as a consequence poorly controlled evolutions of the water level which may have the effect of letting the process develop towards dangerous zones of operation which impose the entering into action of the safety systems of the installation.

These phenomena are particularly sensitive and troublesome in the case of the starting-up of the installation when the power and the feedwater temperature are low with the result that the low static gain does not enable the production of signals which are sufficient to subdue large disturbances during the increase in power. In reality the difficulties connected with the appearance of casual disturbances during the starting-up period lead operators to avoid the use of the automatic regulation device and to carry out starting-up manually and make necessary a considerable mobilization of operators.

Hence it is seen that the reduction of the gain in the regulation loop under the conditions when instabilities appear, introduces a risk of bringing about variations in level beyond safety limits and the setting into operation of the safety devices upon the secondary portion or upon the nuclear portion of the reactor through inadequacy of the actions upon the feedwater flow caused by signals of low amplitude.

In particular, if the rise in power demands a very rapid increase in the flow of steam the supply of water by the low-flow valve employed at low load may be insufficient and the steam demand may cause abrupt lowering of the water in the steam generator which may bring about emergency stopping of the reactor.

SUMMARY OF THE INVENTION

Hence the aim of the invention is to propose an improvement in the present method of regulation of the water level in boilers or steam generators during the course of operation and more particularly during the starting-up phase, in which the inlet flow of feedwater is regulated in response to a deviation signal proportional to the difference $\xi$ between the real measured water level and a reference level the proportionality factor or gain being a linear function of the power level of the boiler or steam generator with respect to its nominal power, this being an improvement which enables powerful actions to be controlled at low load, entirely automatic start-ups to be carried out, damping at maximum load to be improved, wear upon the regulating organs, for example the valves, to be reduced by reduction of the demand upon them in continuous normal operation and the resumption of manual control to be avoided in the case of excessive disturbance.

With this object, for values of $\xi$ lying within a restricted range spanning the value zero the deviation signal which is linear with respect to the power level is modified by a second signal which is a function of the difference in level $\xi$, this non-linear function of $\xi$ preserving very low values for low values of $\xi$ and increasing very rapidly for higher values of $\xi$ so as to increase the total gain for low power levels and high values of $\xi$ within the restricted range.

By way of non-restrictive example there will now be described by referring to the sole FIGURE attached, an embodiment of the invention in the case of a steam generator for a pressurized-water reactor.

BRIEF DESCRIPTION OF THE DRAWING

The sole FIGURE represents diagrammatically the regulation chain associated with the valves for admission of feedwater into a steam generator of a pressurized-water reactor.

DETAILED DESCRIPTION

In the FIGURE is shown diagrammatically at 1 the steam generator, this generator being fed with water under pressure by a circuit 2 in communication with the vessel of the nuclear reactor.

The steam generator likewise receives feedwater at 3 by way of a conduit 4 and produces steam which is sent at the upper portion through a conduit 5 into a steam collector 6 which feeds the turbine 7 with steam.

At the outlet from the turbine the steam is condensed in a condenser 8 which feeds a conduit 9 in which the water recovered is sent by pumps 10 into reheaters 12 which receive their calories from the steam leaving different stages of the turbine.

At the outlet from the battery of reheaters 12 the feedwater returns into the feed conduit 4 in order to be admitted by way of the valves 14 and 15 with a controlled flow into the steam generator 1 at 3.

The valve 14 is a high-flow valve and the valve 15 mounted in shunt with respect to the valve 14 is a low-flow valve. The valves 14 and 15 may be employed alternatively depending upon the flow of feedwater demanded by the steam generator.

The valves 14 and 15 form part of a device 16 enabling the steam generator to be fed with feedwater in a controlled fashion.

In the conduit 4 is arranged a temperature pick-up 18 which enables the temperature of the feedwater to be measured and a signal proportional to this temperature to be supplied permanently to a function generator 19 which generates from this temperature T a function $f_1(T)$ in the form of a signal which is sent to a signal multiplier 20 which receives besides a signal representing the value $\xi$ of the difference between the real water level in the steam generator and a reference level.

The signal is generated by a comparator device 21 which receives on the one hand a signal sent by a device 22 for measurement of the water level in the steam generator and on the other hand a reference signal worked out by a signal generator 23 from the steam pressure in the first stage of the turbine and representative of the power of the turbine.

The amplifier 20 effects the amplification of the signal representing $\xi$ with a gain equal to $f_1(T)$.

At the output from the device 21 the signal representing $\xi$ is picked up on a tap circuit and sent to a function generator 24 which generates a resultant signal $\xi \times f_2(\xi)$, where $f_2(\xi)$ is a function which will be defined below. The signal representing $\xi \times f_2(\xi)$ is sent to a summator 25 which likewise receives from the amplifier 20 the signal representing $\xi \times f_1(T)$.

Hence the summator 25 returns a signal representative of the function $$\xi[f_1(T)+f_2(\xi)] \text{ or } \xi[f_1(T)+|f_2(\xi)|].$$

This signal is received by a regulator 26 of series structure which enables control of the device 16 for feeding water to the steam generator. By way of preferred example, a regulator of the form: $K \times (1+1/\tau ip) \times (1+\tau 1p/1+\tau 2p)$ may be engaged.

The temperature T of the feedwater is itself a function of the level of thermal power demanded of the steam generator, with the result that the function $f_1(T)$ is likewise a function of this level of power W/Wn where W is the instantaneous thermal power demanded of the steam generator and Wn is the nominal power. Hence the signal generated by the function generator 19 is representative of a function $f_1(W/Wn)$.

As may be seen in the FIGURE the function $f_1$ is a linear function of W/Wn.

The value of this function is a minimum for W/Wn=0 and a maximum for W/Wn=1, that is to say, for the nominal power.

Values of this function are chosen in its range of variation in order to have suitable damping during normal operation of the steam generator, that is to say, outside the starting periods or periods of great variation in the regulation parameters.

Thus the valves 14 and 15 which form the regulating members will not be acted upon very much during normal running of the steam generator. Heavy damping in continous operation and in the absence of disturbances is obviously connected with a poor accuracy during this period but this accuracy is sufficient since the disturbances are then weak. The function $f_2(\xi)$ generated at the level of the function generator 24 may have the form represented in the FIGURE characterized by a weak increase in $f_2(\xi)$ in the vicinity of $\xi=0$ and a very rapid increase in $f_2(\xi)$ for slightly higher values of $\xi$.

It may likewise be seen that this function is symmetrical with respect to the origin O, that is to say, that this function adopts opposite values for values $+\xi$ and $-\xi$. This function having odd symmetry in $\xi$ enables the absolute value of $\xi$ to be taken into account and positive and negative deviation signals of the same amplitude to be treated in the same way if at the level of the summator 25 the absolute value of the function $f_2(\xi)$ is added to the function $f_1(W/Wn)$.

It can be seen that thus in continuous operation when the power is established at a certain level, the gain $f_1(W/Wn)$ being then at a certain value which enables a deviation signal to be sent which is amplified sufficiently to compensate for weak disturbances, the deviations in level are themselves rather weak with the result that the function $f_2(\xi)$ has very low values and that the total gain worked out by the summator 25 has a value close to $f_1(W/Wn)$. This gain having been chosen so that the damping is large, the regulating valves 14 and 15 are not acted on very much.

On the contrary in the starting period when $f_1(W/Wn)$ has a low value and when the disturbances are large the function $f_2(\xi)$ adopts large values, the deviations $\xi$ recorded being themselves large.

The total gain obtained at the output from the summator 25 in spite of the low value of $f_1(W/Wn)$ which is a linear function of W/Wn, retains a high value coming from the fact that $\xi \times f_2(\xi)$ has a high value.

The signal sent to the regulator 26 and employed for the control of the flow control device 16 has then a high value at the expense of the damping, which enables the inlet flow of feedwater into the steam generator to be made to vary very rapidly and with a large amplitude. The demand for feedwater can then be followed easily and the setting in operation of the safety devices can be avoided.

The fact that the damping is very low during these exceptional phases does not offer any great disadvantages, the deviation being for this reason rapidly corrected, which brings the function $f_2(\xi)$ rapidly back to a minimum value and enables favorable damping conditions of the system to be recovered.

It is quite obvious that when the feedwater flows demanded by steam generators are large the valve 14 is employed and when these flows are low the valve 15 is employed. In practice the low-flow valve 15 is employed for flows lying between 0 and 15% of nominal flow and the valve 14 for flows higher than 15% of the nominal flow.

Outside of starting periods disturbances may be produced which likewise necessitate a considerable increase in the gain by the signal generator 24 which produces a large signal representative of $\xi \times f_2(\xi)$ when $\xi$ deviates from low values.

Employing the dynamic function generator 24 must however be avoided when the deviations become too large and incompatible with operation of the equipment in complete safety. Hence the generator 24 operates within a restricted range—$\xi O + \xi O$ within which the corrective term is applied to the linear gain in order to enable effective action of the regulating device in the case of large transitory effects, this corrective term being limited to the value $|f_2(\xi O)|$ so as to avoid saturation of the regulating organs.

When the deviation $\xi$ passes outside the range—$\xi O + \xi O$, safety systems are normally provided in order to protect the installation.

Hence it may be seen that the device in accordance with the invention enables automatic regulation of the water level in the steam generator to be carried out as well in continuous operation as at the time of transitory effects of large amplitude, for example, at starting up of the installation which may be carried out entirely automatically thanks to the addition to the signal which is linear with respect to the power level, of a corrective signal which is a non-linear function of the deviation in level. The choice of a series structure of the regulator which enables injection of the deviation signal in series enables full advantage to be taken of the characteristics of the two deviation functions.

But the invention is not restricted to the embodiment which has just been described; it comprises on the contrary any variant upon it and modifications in points of detail can be conceived of without thereby departing from the scope of the invention.

Thus the corrective signal worked out by the function generator 24 may no longer be added to the linear signal $f_1(W/Wn)$ but may serve as a multiplier of this signal, the summator 25 being replaced by a amplifier which enables the gain $f_1(W/Wn)$ to be multiplied by $f_2(\xi)$. In reality, the function $f_2$ being a function having odd symmetry, the gain $f_1$ will be multiplied by the absolute value of $f_2(\xi)$. In this way variations in gain will be able to be obtained which are extremely extended.

The arrangement with addition of the signals has, however, been preferred to the arrangement with multiplication because it enables better severance of the two actions and hence greater facility of regulation in service.

On the other hand the function generator 24 may generate a function of $\xi$ of any different type from that which is represented in the FIGURE provided that this function $f_2(\xi)$ keeps to low values for $\xi$ close to O and adopts large values as soon as $\xi$ deviates from this value, this function $f_2(\xi)$ not being a linear function of the deviation $\xi$.

The method in accordance with the invention may be applied to installations including any number of steam generators, one regulating device being associated with each of these generators which may have a common feedwater circuit.

The invention may likewise be applied to boilers or steam generators outside of those employed in the field of nuclear reactors if the field of use of these boilers or steam generators displays fields of instability in which, however, it is desirable that the system preserve acceptable dynamic performance.

I claim:

1. A method of regulation of the water level in a steam generator during the course of operation and more particularly during the starting-up phase, consisting of the steps of:

measuring the water level in the steam generator, generating a signal representing the difference $\xi$ between the real measured level of water in the steam generator and a reference level, generating a first control signal proportional to the signal representing $\xi$, the proportionality factor or gain being a linear function of the power level of the steam generator with respect to its nominal power, generating a second control signal representing the value—for values of $\xi$ within a restricted range spanning the value zero —of a non-linear function preserving very low values for low values of $\xi$ and increasing very rapidly for higher values of $\xi$ within the restricted range, modifying said first control signal with said second signal so as to increase the total gain for low power levels and high values of $\xi$ within the restricted range, and controlling a device for feeding water to the steam generator, with said modified control signal.

2. A method of regulation as claimed in claim 1, wherein said second signal representing a function of the type $\xi \times f_2(\xi)$ is added with the first control signal.

3. A method of regulation as claimed in claim 1, wherein the first control signal is multiplied by the second signal.

4. A method of regulation as in claim 1 or 2 or 3, wherein the non-linear function $f2(\xi)$ is a function having odd symmetry, one for which $f2(\xi) = -f2(-\xi)$ and the second signal is equal or proportional to the absolute value of $f2(\xi)$.

* * * * *